United States Patent [19]

Koishi et al.

[11] Patent Number: 4,902,596

[45] Date of Patent: Feb. 20, 1990

[54] TONER FOR ELECTROPHOTOGRAPHY WITH THE CHANGE CONTROLLING AGENT DISPERSED THEREIN

[75] Inventors: Masumi Koishi, Sagamihara; Masuyuki Takada, Tokyo; Akio Kazama, Tokyo; Yukio Kawashima, Tokyo, all of Japan

[73] Assignee: Toyo Ink Mfg, Co., Ltd, Tokyo, Japan

[21] Appl. No.: 138,307

[22] Filed: Dec. 28, 1987

[30] Foreign Application Priority Data

Jan. 16, 1987 [JP] Japan ..... 62-7618

[51] Int. Cl.[4] ..... G03G 9/10

[52] U.S. Cl. ..... 430/106.6; 430/108

[58] Field of Search ..... 430/110, 108, 106, 106.6

[56] References Cited

U.S. PATENT DOCUMENTS

| | | | |
|---|---|---|---|
| 3,725,118 | 4/1973 | Fuller et al. | 430/108 |
| 4,395,485 | 7/1983 | Kashiwagi et al. | 430/110 |
| 4,414,322 | 11/1983 | Miyakawa et al. | 430/108 |
| 4,621,039 | 11/1986 | Ciccarelli et al. | 430/110 |

*Primary Examiner*—John L. Goodrow

*Attorney, Agent, or Firm*—Bucknam and Archer

[57] ABSTRACT

A toner for use in electrophotography comprising thermoplastic resin core particles (A) or colorant-embedded thermoplastic resin core particles (A') each having an average particale size of 1 to 15 μm, a charge-controlling agent (B) and carrier particles (C) having an average particle size of 0.05 to 2.0 μm, the charge-controlling agnet (B) being carried on the carrier particles (C), and the carrier particles (C) with the agent (B) carried thereon being embedded in the surfaces of the resin core particles (A) or the colorant-embedded resin core particles (A').

9 Claims, No Drawings

TONER FOR ELECTROPHOTOGRAPHY WITH THE CHANGE CONTROLLING AGENT DISPERSED THEREIN

BACKGROUND OF THE INVENTION

1. Field of the Invention

This invention relates to toners used for the dry development of an electrostatic latent image in electrophotography.

2. Description of the Prior Art

There have heretofore been known several dry developing methods including a method using a two-component developer composed of toner particles mixed with carrier particles such as glass beads or magnetic powder, and a method using a one-component toner composed of toner particles imparted with magnetism. In addition, there has recently been proposed a method using a one-component nonmagnetic toner which is excellent in environment resistance, e.g. temperature, humidity and the like.

These conventional toners have been, in most cases, prepared by methods which comprise mixing, heating and melting thermoplastic resins, colorants such as pigments or dyes and additives such as wax, plasticizers, charge-controlling agents and the like, kneading the pigments or charge-controlling agents, changing the form of secondary agglomeration under the application of intense shearing force to primary particles, uniformly dispersing, if necessary, magnetic powder in the mixture to obtain a uniform composition, cooling and comminuting the composition and then classifying the resulting particles to obtain the toner particles.

However, the conventionl methods have problems that they require a large amount of energy in the step of milling the pigment and charge controlling agent, provide the toner particles in a low yield as low as about 85% because finer toner particles are cut or removed in the step of classification, and exhibit an inevitably low productivity of toner particles although part of the removed toner particles are reused in the next production. Further, in cases where particulate toners which are different from each other in kind, particularly hue, are each produced by any conventional method using an apparatus including devices such as a kneader, grinder and dispenser, such devices must beforehand be thoroughly cleaned every time each of the toners is produced. Since the devices used in the conventional methods are considerably large in scale, the cleaning is a heavy burden to the workers.

Moreover, the toner particles so obtained are qualitatively disadvantageous in that they have the charge-controlling agent insufficently dispersed therein and are non-uniform in size and shape and generally amorphous whereby they are individually different in frictional charging characteristics thus causing them to be stained and scattered within the copying devices. In addition, the toner particles have so low flowability that it becomes difficult to supply them smoothly with many troubles being undesirably involved.

To avoid this, there have been proposed attempts to obtain spherical toners by a spray drying or suspension polymerization process. However, the former process requires proper selection of resins which are soluble in the solution used and raises a problem as to an offset phenomenon on a fixing drum. The latter process raises problems as to blocking and offset phenomena and is therefore not industrially used.

Further, other methods proposed include a method in which binder resin particles and coloring material particles are treated in a hot air stream (Japanese patent application Laid-Open No. 37553/1984) and a method in which a binder resin and a coloring material are deposited on the surface of a spherical resin (Japanese patent application Laid-Open No. 210368/1986). However, these methods involving heat treatment tend to cause the formation of coarse particles due to the fusion of fine particles and have not yet been put to practical use.

Conventional toners have the common disadvantage that the colorant and charge controlling agent, which exhibit their characteristic properties on the toner surface and are relatively expensive as starting materials for the toners, are not economically contained not only in the surface portion of the toner but also in the interior.

In order to solve this problem, one of the present inventors proposed a toner produced by mixing a toner for use in electrophotography with a charge controlling agent while applying mechanical strain force to embed the charge controlling agent in the surface of the toner (Japanese patent application No. 51481/1986). However, it was found that, even with this improved method, the desired charge control cannot be often attained depending on the formulation of the toner and the conditions of production. Specifically, when the surface of the core particles (A) is preliminary coated with an electrically conductive material such as carbon black or a surfactant, difficulties are encountered in controlling the charges even when the charge controlling agent (B) is embedded in the surface of the core particles (A) by the above-mentioned method. The reason for this has not yet been fully elucidated. In any way, as is apparent from the foregoing description, the conventional toners still present problems to be solved.

SUMMARY OF THE INVENTION

An object of the present invention is to solve the above-mentioned problems and to provide a toner which can be prepared with excellent productivity and can produce a clear image free from fogging.

The present inventors have made extensive and intensive studies. As a result, the present inventors have found that a toner for use in electrophotography, which is superior in productivity and sharpness in charge distribution to the conventional toners, can be stably obtained by mixing thermoplastic resin core particles (A) with carrier particles (C) having an average particle size of from 0.05 to 2.0 μm, preferably 0.08 to 2.0 μm and carrying a charge controlling agent (B) on the surface thereof while applying mechanical strain force under such conditions that the resulting toner particles have an average particle size of from 1 to 20 μm, thereby embedding the carrier particles (C) in the surface of the core particles. The present invention is based on this finding. Specifically, in accordance with the present invention, there is provided a toner for use in electrophotography comprising thermoplastic resin core particles (A) or (A') and carrier powders (C) which carry a charge controlling agent (B) on the surface thereof and are embedded in the surface of said core particles (A) or (A'), said toner being produced by mixing the core particles (A) having an average particle size of from 1 to 15 μm or the core particles (A') having an average particle size of from 1 to 15 μm and containing colorant particles embedded in the surface thereof, with carrier particles (C) having an average particle size of from 0.1 to 2.0 μm and carrying a charge controlling agent (B) on the surface thereof while applying mechanical strain force to the resulting mixture under such conditions that the resulting toner particles have an average particle size of from 1 to 20 μm. The state wherein "carrier particles (C) which carry a charge controlling agent (B) on the surfaces thereof are embedded in the surface of core particles (A)" as described herein refers to such a state that part of the carrier particles (C) are exposed on the surface of the core particle (A) without being completely buried in the core particles (A). In this state, part of the charge controlling agent (B) carried on the carrier particles (C) are exposed on the surfaces of the core particles (A). However, it is not necessary that all of the carrier particles (C) be exposed on the surfaces of the core particles (A).

In the present specification, the particle size was measured with a Coulter Counter Model TAII (a product of Coulter Electronics Co., Ltd.) and expressed on the volume basis.

DETAILED DESCRIPTION AND PREFERRED EMBODIMENTS OF THE INVENTION

The core particles used in the present invention may be those obtained by conventional methods, i.e., by mixing a thermoplastic resin with a coloring material and, if necessary, additives such as a lubricant, followed by being subjected to a series of procedures such as melting, kneading, allowing to cool, coarse grinding, grinding, and then classification. Alternatively, the core particles may be those obtained by embedding a coloring material substantially as a primary particle in the surfaces of resin particles through the mixing operation under the same mechanical strain force as that of the present invention. Although the colorant such as pigment exists as a secondary agglomeration, since the colorant thus obtained by mixing operation is embedded to the surface of the core particle substantially as a primary particle, colorant core particle having tinting power and brightness is obtained (see U.S. patent application No. 020,585).

Examples of thermoplastic resins for the core particles which may be used in the present invention include known binder resins, e.g., polystyrene resins, copolymer resins containing styrene, such as copolymer of styrene with acrylate, methacrylate, acrylonitrile or maleate, polyacrylate resins, polymethacrylate resins, polyester resins, polyamide resins, polyvinyl acetate resins, epoxy resins, phenolic resins, hydrocarbon resins, petroleum resins, and chlorinated paraffins. Further, it is preferred that the thermoplastic resins be solid at room temperature and have a heat softening temperature of 50° C. or higher. These may be used alone or in the form of any mixture. With respect to other additives, coloring materials such as pigment and dye, magnetic powder, lubricants such as wax, fluidizers such as colloidal silica, and low-molecular weight polyolefins may be used in combination according to the purposes. When they are used in the form of fine particles, they can be also embedded in the same manner as that described above with respect to the carrier particles (C). It is preferred that the core particles (A) be substantially free from particles having a particle size of 25 μm or more. Although it is generally believed that fine particles having a size of 1 μm or less are unfavorable, it is not necessary in the present invention, as is mentioned later, that such fine particles be removed because the particle sizes are regulated by the mixing treatment.

Examples of the coloring material include white and black pigments or dyes, such as zinc yellow, yellow iron oxide, hansa yellow, disazo yellow, quinoline yellow, permanent yellow, red iron oxide, permanent red, lithol red, pyrazolone red, watchung red calcium salt, watchung red manganese salt, lake red C, lake red D, brilliant carmine 6B, brilliant carmine 3B, prussian blue, phthalocyanine blue, metal-free phthalocyanine, titanium white, and carbon black.

Examples of the carrier particles (C) include inorganic fine powders such as alumina, titanium dioxide, barium titanate, magnesium titanate, strontium titanate, zinc oxide, iron oxide, barium sulfate, silicon carbide, cerium oxide, silica, and carbon powder; fine particles of resins such as polyvinylidene fluoride, copolymers of vinylidene fluoride with vinyl fluoride, trifluoroethylene, ethylene, propylene, butene or the like, polystyrene, styrene-methyl methacrylate copolymer, xylene resin, polyamide, petroleum resins such as cumarone-indene resin, benzoguanamine resin, phenolic resin, melamine resin, epoxy resin, and unsaturated polyester resin; and fine particles of organic substances, e.g., waxes such as polyethylene wax and amide wax and metal salts of fatty acids, such as calcium stearate, aluminum stearate, and zinc stearate. It is preferred that these fine particles have a particle size of from 0.1 to 2.0 μm. When the particle size is too large, the carrier particles cannot be uniformly embedded in the core particles (A). On the other hand, the particle size is too small, the carrier particles (C) are completely embedded in the inside of the core particles (A), which makes it impossible to attain the main object. Further, it is preferred that the carrier particles (C) be solid at room temperature and have a heat softening temperature of 50° C. or above.

In the present invention, although the methods of carrying the charge controlling agent (B) on the surface of the carrier particles (C) are not particularly limited, it is preferred that the charge controlling agent be deposited to attain a sufficient strength. A preferable method for attaining this purpose comprises subjecting both components to wet mixing, drying the resulting mixture and, if necessary, grinding the dried mixture. Specifically, 1 weight part of the charge controlling agent (B) and 1 to 10 weight parts of the carrier particles (C) are milled using a ball mill, a sand mill or an attritor in the presence of a suitable medium, such as water or an organic solvent, followed by drying and grinding. The resulting product can be advantageously used in the present invention.

The charge controlling agent (B) used in the present invention may be one known in the art, and examples include dyes and metal-containing dyes such as Fettschwarz HBN, Nigrosine Base, Brilliant Spirit, Zapon Black X, Ceres Black RG, copper-phthalocyanine dye; other dyes such as C.I. Solvent Black 1, 2, 3, 5, and 7, C.I. Acid Black 123, 22, 23, 28, 42, and 43, Oil Black (C.I. 26150) and Spiron Black; quaternary ammonium salt; metal salt of naphthenic acid; and metallic soaps of fatty acids and resin acid. In the present invention, in mixing the core particles (A) with the carrier particles (C) carrying the charge controlling agent (B) on the surfaces through the application of mechanical strain force under such conditions that the resulting toner particles have an average particle size of from 1 to 20

μm, it is necessary that the mixing be conducted so as not to cause unfavorable phenomena such as fusion of the core particles (A) to form a large mass and grinding into finely divided particles due to the application of excessive strain force and at the same time, so as to embed part of the carrier particles (C) carrying the charge controlling agent (B) on the surfaces in the surfaces of the core particles (A). In the case of commercial scale production, both of the above-mentioned requirements can be met by varying the operating conditions of a dispenser such as a ball mill or a sand mill etc. and conditions such as loading and dispersing medium so as to attain the above-mentioned purpose.

However, the mixing step with a ball mill or a sand mill requires much time. In this respect, mixers preferable from the stand point of commercial scale production include one in which particles are fluidized together with an air stream at a high speed and one equipped with a blade or a hammer capable of applying percussions. Examples of such mixers include an SI mill (a product of Toyo Ink Mfg. Co., Ltd.; some description on an SI mill is given in Japanese patent application Publication No. 43051/1982), an atomizer, a Jiyu Mill (a product of Nara Machinery Co., Ltd.), a grinder manufactured by Kawasaki Heavy Industries, Ltd. (KTM-1), and a Hybridizer (a product of Nara Machinery Co., Ltd.). These devices may be used as they are or used after they are modified according to the purposes of the present invention. If possible, it is preferred that a hermetically sealed device of circulation type, e.g., a Hybridizer, be used.

Further, it is preferred that the core particles (A) be pre-mixed with the carrier particles (C) carrying the charge controlling agent (B) on the surfaces and other fine particles under stirring conditions milder that those of the above-mentioned mixing treatment, e.g., in a Henschel mixer. The pre-mixing causes the fine particles such as the particles (C) to be electrostatically deposited on the core particles (A), which contributes to the uniform embedding of the fine particles in the core particles (A).

The reason why the mixing treatment causes such an effect that the carrier particles (C) carrying the charge controlling agent (B) on the surfaces are embedded on the surfaces of the core particles (A) is believed to reside in that these particles come into collision with each other or with the wall, blade or dispersing medium such as beads to instantaneously and partly generate a considerably high temperature, which leads to occurrence of a phenomenon similar to a mechanical reaction in the field of inorganic chemistry. Therefore, it is sometimes necessary that the system be allowed to cool. When the air stream temperature in the system is raised to around the $T_g$ (glass transition point) of the resin, the particles tend to fuse to each other.

The above-mentioned phenomenon can be confirmed through examination of electron photomicrograph prior to mixing treatment, i.e., after pre-mixing, and after mixing treatment. Specifically, before the mixing treatment, the core particles (A) having a relatively broad particle size distribution and the carrier particles (C) carrying the charge controlling agent (B) on the surfaces are in a partly agglomerated state. On the other hand, after the mixing treatment, the core particles (A) are in a smooth state as a result of the removal of the angular portion thereof, and it is observed that the carrier particles (C) are embedded in the surface of the core particles (A). The resulting particles were hardly broken by the running test conducted within a copying device. Further, since the charge controlling agent (B) is present on the surface of the toner, the amount of the charge can be effectively regulated by the use of a small amount of the charge controlling agent (B).

Various factors for attaining the above-mentioned effects may be mentioned. According to the studies conducted by the present inventors, the most important factor is the speed of the air stream of the mixing devices and it is preferred that the speed of the air stream be several tens to several hundreds m/sec.

In the present invention, it is preferred that the toner particles have such a particle size distribution that they have an average particle size of from 1 to 20 μm and are free from particles having a size of 0.5 μm or less and 25 μm or more. The presence of a large amount of the toner particles having a size of 0.5 μm or less brings about a lowering in the flow, which leads to the occurrence of staining of copied paper. On the other hand, the presence of a large amount of the toner particles having a size of 25 μm or more leads to the formation of a roughened image, which brings about a reduction in the commercial value. However, the toner according to the present invention does not need any particular classification because the particles having a size of 0.5 μm or less is regulated with respect to the particle size.

In the present invention, when the production of a magnetic toner is intended, known thermoplastic resin core particles containing magnetic powders may be used. Alternatively, if necessary, core particles (A) having magnetic particles embedded therein obtained by the same procedures as those adopted in the present invention may be also used. The magnetic particles are not particularly limited. However, it is preferred that finely divided magnetic particles having an average particle size of 1 μm or less, preferably 0.5 μm or less, be used when the magnetic toner is produced by the latter method. Examples of the magnetic particles known in the art, include various ferrites, magnetite, hematite, and alloys or compounds of iron, zinc, cobalt, nickel, and manganese. These magnetic particles may be those which were subjected to classification according to the purposes or known surface treatment, e.g., hydrophobic treatment or silane coupling agent treatment.

The present invention will now be described with reference to the following examples. In the examples, all the parts are by weight.

REFERENCE EXAMPLE 1

100 parts of carbon powder (Sevacarb MT-CI; trade name of a product of Columbia Carbon Co., Ltd.; an average particle size of 0.35 μm), 20 parts of a charge controlling agent (PNR-BE; trademark of a product of Orient Chemical Industries, Ltd.), and 200 parts of water were mixed with each other in a ball mill for 24 hours. The mixture was filtered and then dried at 100° C. for 24 hours to obtain carrier particles (1) carrying a charge controlling agent on the surfaces of carbon powder.

REFERENCE EXAMPLE 2

Carrier particles (2) were produced in the same manner as that of Reference Example 1, except that Oil Black 1010 (trademark of a product of Chuo Synthetic Chemical Co., Ltd.) was used as the charge controlling agent.

REFERENCE EXAMPLE 3

Carrier particles (3) were produced in the same manner as that of Reference Example 1, except that 100 parts of barium sulfate (B-30; trade name of Onahama Sakai Chemical Co., Ltd.; an average particle size of 0.3 μm), 20 parts of a charge controlling agent (PNR-BE; trademark of a product of Orient Chemical Industries, Ltd.), and 140 parts of water were used.

REFERENCE EXAMPLE 4

Carrier particles (4) were produced in the same manner as that of Reference Example 3, except that precipitated barium sulfate 100 (trade name of a product of Onahama Sakai Chemical Co., Ltd.; an average particle size of 0.6 μm) was used as barium sulfate.

REFERENCE EXAMPLE 5

Carrier particles (5) were produced in the same manner as that of Reference Example 3, except that precipitated barium sulfate 300 (trade name of a product of Onahama Sakai Chemical Co., Ltd.; an average particle size of 0.8 μm) was used as barium sulfate.

REFERENCE EXAMPLE 6

Carrier particles (6) were produced in the same manner as that of Reference Example 3, except that 100 parts of the same barium sulfate as that used in Reference Example 3, 20 parts of a charge controlling agent (E-84; trademark of a product of Orient Chemical Industries, Ltd.), and 150 parts of water were used.

REFERENCE EXAMPLE 7

Carrier particles (7) were produced in the same manner as that of Reference Example 5, except that the amounts of barium sulfate and the charge controlling agent were 100 parts and 10 parts, respectively.

REFERENCE EXAMPLE 8

Carrier particles (8) were produced in the same manner as that of Reference Example 5, except that the amounts of barium sulfate and the charge controlling agent were 100 parts and 30 parts, respectively.

REFERENCE EXAMPLE 9

Carrier particles (9) were produced in the same manner as that of Reference Example 2, except that particles having a size of about 0.5 μm obtained by classification of benzoguanamine resin particles (EP-S; trade name of a product of Nippon Shokubai Kagaku Kogyo Co., Ltd.) were used instead of the carbon powder.

EXAMPLE 1

96 parts of a styrene-acrylic resin (Nikalite NC-6100; trade name of a product of Nippon Carbide Industries Co., Ltd.) and 4 parts of low-molecular weight polypropylene (Viscol 550 P; trade name of a product of Sanyo Chemical Industry Ltd.) were mixed with each other in a Henschel mixer. The resulting mixture was molten, kneaded and allowed to cool in a twin-screw extruder. The kneading product was coarsely ground and then fed in a type I jet mill to obtain resin particles having a maximum particle size of 25 μm or less and an average particle size of about 10 μm.

100 parts of the resin particles and 4 parts of carbon black (Monarch 880; trade name of a product of Cabot Corporation; a particle diameter of 16 m μ) were premixed with each other in a Henschel mixer at a circumferential speed of 10 m/sec for 10 minutes to deposit carbon black on the surfaces of the resin particles. 100 g of the treated resin particles were fed into a Hybridizer (Model NHS-1). The Hybridizer was operated at 8,000 rpm for 2 minutes to obtain core particles in which the carbon black was embedded. During this step, the Hybridizer was cooled with water of 20° C.

100 parts of the core particles and 6 parts of the carrier powders (1) were subjected to the pre-mixing treatment and the mixing treatment in a Hybridizer in the same manner as that described above, thereby obtaining a toner having an average particle size of about 11 μm and substantially free from particles having a size of 5 μm or less and 25 μm or more.

The amount of blow-off electrification of the toner thus obtained was −20 μc/g, and the measurement with a particle change measuring device (a product of Hosokawa Micron Corporation) revealed that the toner was substantially free from toner particles having a reversed polarity.

100 parts of the toner was added and mixed with 0.3 parts of finely divided silica (R-972; trade name of a product of Nippon Aerosil Co., Ltd.). The resulting mixture was further mixed with 900 parts of an iron powder carrier to prepare a two-component developing agent. The developing agent was set within a copying machine manufactured by Toshiba Corp. (trade name: BF-8411). The copying on plain paper was continuously conducted by making use of a test chart.

In this copying test, the toner was excellent in charge stability, fixability, blocking resistance, and offset resistance and provided an image substantially free from scumming and fogging. Further, in a running test in which the copying operation was conducted while supplying the toner in a supply hopper of the copying machine, the toner was smoothly supplied, and the quality of the initial image was maintained until the image was duplicated on 60,000 pieces of plain paper.

EXAMPLE 2

A flask was charged with 500 parts of purified water and 8 parts of polyvinyl alcohol and maintained at 80° C. under a nitrogen gas stream. 50 parts of butyl acrylate and 1 part of benzoyl peroxide were added while stirring to the flask for about 30 minutes. The resulting mixture was maintained at that temperature for 30 minutes while stirring. Thereafter, 400 parts of styrene, 50 parts of butyl acrylate, and 4 parts of benzoyl peroxide were added thereto in about 2 hours. The stirring was further continued at 80° C. for 4 hours, and the resulting product was dried at a low temperature, thereby obtaining pearl polymerization resin particles having an average particle size of 11.5 μm. The same procedures as those of Example 1 were repeated to obtain a toner, except that the above-prepared pearl polymerization resin particles were used. The toner had an average particle size of about 12.5 μm and an amount of blow-off electrification of −17 μc/g and exhibited excellent properties comparable to those of the toner as produced in Example 1.

COMPARATIVE EXAMPLE 1

A toner was produced in the same manner as that of Example 1, except that 1 part of a change controlling agent (PNR-BE) which had been subjected to classification to obtain particles having a size of 1 μm was used instead of the carrier particles (1). The toner thus obtained had an amount of blow-off electrification of −9

μc/g. The toner was applied to the same test as that of Example 1. The above-obtained toner was inferior in resistance to scumming and fogging to the toners as produced in Examples 1 and 2.

COMPARATIVE EXAMPLE 2

A toner was produced using the same starting materials as those of Example 1 by a conventional method.

Specifically, 96 parts of a styrene-acrylic resin, 4 parts of low-molecular weight polypropylene, 4 parts of carbon black, and 3 parts of a charge controlling agent (used in an increased amount because of the incorporation method employed) were pre-mixed with each other in a Henschel mixer. The resulting mixture was molten, kneaded and allowed to cool in a twin-screw extruder, followed by coarse grinding. The coarse powders thus obtained were ground in a type I jet mill grinder and then subjected to classification to obtain a toner having a particle size of from 5 to 25 μm. The toner was applied to the same test as that of Example 1. The above-obtained toner was inferior in resistance to scumming and fogging to the toners as produced in Examples 1 and 2 and further caused a bridging phenomenon within the toner hopper.

EXAMPLE 3

A toner was produced in the same manner as that of Example 1, except that the carrier particles (2) were used instead of the carrier particles (1).

The amount of blow-off electrification of the toner was obtained was +19 μc/g, and the measurement with a particle charge measuring device (a product of Hosokawa Micron Co., Ltd.) revealed that the toner was substantially free from toner particles having a reversed polarity.

100 parts of the toner was added and mixed with 0.1 part of finely divided silica (R-972; trade name of a product of Nippon Aerosil Co., Ltd.). The resulting mixture was further mixed with 900 parts of an iron powder carrier to prepare a two-component developing agent. The developing agent was set within a copying machine manufactured by Sharp Corporation (trade name: SF8100). The duplication of an image on plain paper was continuously conducted by making use of a test chart.

In this copying test, the toner was excellent in charge stability, fixability, blocking resistance, and offset resistance and provided an image substantially free from scumming and fogging. Further, in a running test in which the copying operation was conducted while supplying the toner in a supply hopper of the copying machine, the toner was smoothly supplied, and the quality of the initial image was maintained until the image was duplicated on 60,000 pieces of plain paper.

EXAMPLE 4

The same procedures as those of Example 1 were repeated, except that 53 parts of a styrene-acrylic resin (Himer SMB73; trade name of a product of Sanyo Chemical Industry Ltd.), 42 parts of magnetic particles (MAT-305 HD; trade name of a product of Toda Kogyo Corporation; a particle size of 0.2 μm), and 3 parts of low-molecular weight polypropylene (Viscol 550P; a product of Sanyo Chemical Industry Ltd.) were used, thereby obtaining resin particles having a maximum particle size of 25 μm or less and an average particle size of 10 μm.

98 parts of the resin particles and 2 parts of carbon black (Monarch 880; trade name of a product of Cabot Corporation; a particle size of 16 mμ) were subjected to the pre-mixing treatment and the mixing treatment with a Hybridizer in the same manner as that of Example 1 to obtain core particles having carbon black embedded on the surfaces thereof.

100 parts of the core particles and 6 parts of the carrier particles (3) were subjected to the pre-mixing treatment and the mixing treatment with a Hybridizer in the same manner as that of Example 1 to obtain a toner having an average particle size of about 12 μm and substantially free from particles having a size of 5 μm or less and 25 μm or more.

The toner had an amount of blow-off electrification of −26 μc/g and exhibited excellent charge distribution. 100 parts of the toner was added and mixed with 0.3 parts of finely divided silica (R-972; trade name of a product of Nippon Aerosil Co., Ltd.). The resulting mixture was set within a copying machine manufactured by Canon Inc. (trade name: NP300 Z). The duplication of an image on plain paper was continuously conducted by making use of a test chart.

In this copying test, the toner was excellent in charge stability, fixability, blocking resistance, and offset resistance and provided an image substantially free from scumming and fogging. Further, in a running test, the toner was smoothly supplied, and the quality of the initial image was maintained until the image was duplicated on 50,000 pieces of plain paper.

EXAMPLE 5

Two kinds of toners were produced in the same manner as that of Example 4, except that the carrier particles (4) and the carrier particles (5) were used instead of the carrier particles (3).

These toners were applied to the same test as that of Example 4. They exhibited excellent results comparable to those of Example 4.

EXAMPLE 6

100 parts of the resin as used in Example 1 and 4 parts of a red azo pigment were subjected to the pre-mixing treatment and the mixing treatment in a Hybridizer in the same manner as that of Example 1, thereby obtaining core particles having a red azo pigment embedded on the surfaces thereof.

100 parts of the core particles and 6 parts of the carrier particles (6) were subjected to the pre-mixing treatment and the mixing treatment in a Hybridizer in the same manner as that of Example 1 to obtain a toner.

The toner had an amount of blow-off electrification of −24 μc/g and exhibited excellent charge distribution.

100 parts of the toner was added and mixed with 0.3 parts of finely divided silica (R-972; trade name of a product of Nippon Aerosil Co., Ltd.). The resulting mixture was further mixed with 900 parts of an iron powder carrier and then set within a copying machine manufactured by Mita Industrial Co., Ltd. (trade name: DC-232). The duplication of an image on plain paper was continuously conducted by making use of a test chart. The toner exhibited excellent results comparable to those of Example 1.

EXAMPLE 7

A toner was produced in the same manner as that of Example 6, except that 12 parts of the carrier particles (7) were used instead of the carrier particles (6). This toner was applied to the same test as that of Example 6. The toner exhibited excellent results comparable to those of Example 6.

EXAMPLE 8

A toner was produced in the same manner as that of Example 6, except that 4 parts of the carrier particles (8) was used instead of the carrier particles (6). This toner was applied to the same test as that of Example 6. The toner exhibited excellent results comparable to those of Example 6.

EXAMPLE 9

A toner was produced in the same manner as that of Example 3, except that 4 parts of the carrier particles (9) was used instead of the carrier particles (2). This toner was applied to the same test as that of Example 3. The toner exhibited excellent results comparable to those of Example 3.

What is claimed is:

1. A toner for use in electrophotography comprising thermoplastic resin core particles (A) having an average particle size of from 1 to 15 μm, a charge controlling agent (B) and carrier particles (C) having an average particle size of from 0.05 to 2.0 μm, the charge controlling agent (B) being carried on the surfaces of the carrier particles (C), and the carrier particles (C) with the agent (B) carried thereon being embedded in the surfaces of the resin core particles (A) by mixing the core particles (A) and the carrier particles (C) with the agent (B) carried thereon while applying mechanical strain force to the mixed materials under such conditions that the resulting toner particles have an average particle size of from 1 to 20 μm.

2. A toner for use in electrophotography according to claim 1, wherein the carrier particles (C) with the charge controlling agent (B) carried thereon are those produced by wet mixing the charge controlling agent (B) with the carrier particles (C) having an average particle size of from 0.05 to 2.0 μm to tightly adhere the charge controlling agent (B) to the carrier particles (C).

3. A toner for use in electrophotography according to claim 1, wherein the thermoplastic resin core particles (A) are pre-mixed with the carrier particles (C) with the charge controlling agent (B) carried thereon under stirring conditions milder than those obtained in the mixing treatment using said mechanical strain force.

4. A toner for use in electrophotography according to claim 1, wherein magnetic particles are preliminarily mixed in said thermoplastic resin core particles (A).

5. A toner for use in electrophotography according to claim 1, wherein the colorant is preliminarily mixed in said thermoplastic resin core particles (A).

6. A toner for use in electrophotography comprising colorant-embedded thermoplastic resin core particles (A′) having an average particle size of from 1 to 15 μm, a charge-controlling agent (B) and carrier particles (C) having an average particle size of from 0.1 to 2.0 μm and carrying a charge-controlling agent (B) on the surfaces thereof, the colorant being embedded in the original thermoplastic core particles by mixing the colorant and the original core particles while applying mechanical strain force to the mixed materials under such conditions that the resulting colorant-embedded core particles have an average particle size of from 1 to 15 μm, and the carrier particles (C) with the charge-controlling agent (B) carried thereon being embedded in the colorant-embedded resin core particles (A′) by mixing the resin core particles (A′) and the carrier particles (C) with the agent (B) carried thereon while applying mechanical strain force to the mixed materials under such conditions that the resulting toner particles have an average particle size of from 1 to 20 μm.

7. A toner for use in electrophotography according to claim 6, wherein the colorant is a pigment.

8. The toner according to claim 1 wherein said thermoplastic resin is a solid at room temperature and has heat softening temperature of at least 50° C.

9. The toner according to claim 1 wherein one part by weight of said charge controlling agent (B) is mixed with 1–10 parts by weight of said carrier particles (c).

* * * * *